United States Patent [19]

Saud

[11] Patent Number: 5,021,183

[45] **Date of Patent: * Jun. 4, 1991**

[54] SOAP COMPOSITION

[76] Inventor: Abel Saud, 6060 Center Hill Rd., Cincinnati, Ohio 45224

[ * ] Notice: The portion of the term of this patent subsequent to Nov. 3, 2004 has been disclaimed.

[21] Appl. No.: 241,683

[22] Filed: Sep. 7, 1988

Related U.S. Application Data

[63] Continuation of Ser. No. 104,474, Oct. 8, 1987, abandoned, which is a continuation-in-part of Ser. No. 923,379, Oct. 27, 1986, Pat. No. 4,704,224.

[51] Int. Cl.[5] ..... C11D 1/50

[52] U.S. Cl. ..... 252/108; 252/132; 252/134; 252/174.17; 252/DIG. 2; 252/DIG. 16

[58] Field of Search ..... 252/132, 108, 134, 174.17, 252/DIG. 2, DIG. 16

[56] References Cited

U.S. PATENT DOCUMENTS

| | | | |
|---|---|---|---|
| 4,061,602 | 12/1977 | Oberstar | 252/547 |
| 4,472,297 | 9/1984 | Bolich | 252/531 |
| 4,491,539 | 1/1985 | Hoskins | 252/541 |
| 4,540,507 | 9/1985 | Grollier | 252/174.23 |
| 4,673,525 | 6/1987 | Small | 252/132 |
| 4,704,224 | 11/1987 | Saud | 252/132 |
| 4,714,563 | 12/1987 | Kajs | 252/107 |

FOREIGN PATENT DOCUMENTS

| | | | |
|---|---|---|---|
| 0002085 | 5/1979 | European Pat. Off. | 252/8.8 |

*Primary Examiner*—John F. Niebling
*Assistant Examiner*—Isabelle R. McAndrews
*Attorney, Agent, or Firm*—Monte D. Witte; Thomas H. O'Flaherty; Richard C. Witte

[57] ABSTRACT

Personal cleansing compositions comprising alkali metal soap and nonionic guar gum-fatty acid-alkali metal hydroxide complex and exhibiting improved physical properties, lather properties, and mildness. The toilet bars comprise alkali metal soap and from about 0.5 to about 8% by weight nonionic guar gum, which guar gum is provided as a pre-reacted complex prepared by suspending one part by weight guar gum in from about 1 to about 12 parts by weight molten fatty acid and reacting with the suspension from about 0.03 to about 0.2 part by weight alkali metal hydroxide per each part by weight coconut fatty acid.

10 Claims, No Drawings

SOAP COMPOSITION

CROSS-REFERENCE TO RELATED APPLICATION

This is a continuation-in-part of application Ser. No. 06/923,379, filed Oct. 27, 1986.

FIELD OF THE INVENTION

This invention pertains to personal cleansing compositions for personal washing, such as toilet bars, which compositions comprise a guar gum-fatty acid-alkali metal hydroxide complex for lather and mildness enhancement.

BACKGROUND OF THE INVENTION

Toilet bars based on soap (alkali metal salts of fatty acids) are commonly used for cleansing the human body. A wide variety of additives have been suggested for inclusion in toilet bars to enhance the physical properties of the bar (hardness, wear rate, resistance to water), the use properties of the toilet bar (lather characteristics such as volume and texture), and the impression the bar has on the skin both during washing and afterwards.

For example, lather enhancement has been achieved in several ways. First, soaps derived from shorter chain length fatty acids such as coconut fatty acids are known to produce a much richer lather than soaps produced from longer chain length fatty acids such as tallow fatty acids. It has been common practice in toilet bar manufacture to add up to about 50% coconut fatty acid to the tallow fatty acid feed stock used to make the soap. Second, super fatting agents such as free coconut fatty acid are also known to improve the volume and richness of the lather produced by a toilet bar when it is added to the bars at levels of up to about 10%. At higher levels of addition, however, coconut fatty acid soaps have a detrimental effect on bar mildness while free coconut fatty acids can produce undesirable softening of the bar. Further, coconut soaps and fatty acids are both expensive commodities; it would be desirable to achieve improvements in lathering without recourse to higher levels of such ingredients.

It has also been discovered that the addition of polymeric materials to toilet bars can have a beneficial effect on bar lathering characteristics without deleteriously affecting other bar properties. These polymers should be soluble or dispersible in water to a level of at least 1% by weight, preferably at least 5% by weight at 25° C. Suitable polymers are high molecular weight materials (mass-average molecular weight determined, for instance, by light scattering, being generally from about 20,000 to about 5,000,000, preferably from about 50,000 to about 4,000,000, and more preferably from about 500,000 to about 3,000,000) and preferably have a thickening ability such that a 1% dispersion of the polymer in water at 20° C. exceeds about 1 PaS(10 poise) at a shear rate of $10^{-2}$ $sec^{-1}$. Useful polymers are the cationic, nonionic, amphoteric, and anionic polymers useful in the cosmetic field. Preferred are cationic and nonionic resins and mixtures thereof. Highly preferred are the cationic resins. The level of polymer is from about 0.01% to about 5%, preferably from about 0.1% to about 2%. (Unless otherwise specified, all percentages in this specification are percentages by weight.) Suitable cationic polymers include cationic guar gums such as hydroxyproxyltrimethylanmonium guar gum such as that available commercially under the trademarks Jaguar C-17 and Jaguar C-15 as marketed by Hi-Tek Polymers of Louisville, Kentucky. Nonionic polymers include guar gum and hydroxypropyl guar gum.

SUMMARY OF THE INVENTION

The present invention is of a soap composition (or toilet bar) comprising from about 65% to about 90% by weight alkali metal soap (anhydrous basis) and from about 0.5% to about 8% by weight nonionic guar gum, the nonionic guar gum being provided by (i.e. contained in) a pre-reacted nonionic guar gum-fatty acid-alkali metal hydroxide complex (hereinafter referred to as the "guar gum-FA complex"). The guar gum-FA complex is prepared by suspending one part by weight nonionic guar gum in from about 1 to about 12 parts by weight molten (liquified) fatty acid and reacting therewith from about 0.03 to about 0.2 part by weight alkali metal hydroxide per each part by weight of fatty acid.

Compared to conventional toilet bars prepared from soap, or to toilet bars containing either or both nonionic guar gum and fatty acid, the toilet bars of this invention exhibit enhanced lathering characteristics when used by people for cleansing the body, and they are unusually mild. For example, the volume of lather produced by bars of the present invention is somewhat greater than the volume of lather produced by bars of base soap alone and is almost as great as the volume of the lather produced by bars containing an excess of coconut fatty acid soap. Likewise, the speed of lathering of bars of the present invention is considerably greater than bars of base soap alone and is almost as great as that of similar bars containing an excess of coconut fatty acid soap. Both the volume of lather and the speed of lathering of the bars of the present invention are considerably greater than similar properties of similar soap bars containing an excess of guar gum and sodium hydroxide. The creaminess of the lather produced by the bars of the present invention is significantly greater than that of the lather produced by bars containing coconut fatty acid soap or nonionic guar gum alone. Further, the toilet bars of the present invention exhibit considerably enhanced wear rate as compared to toilet bars with no additives and somewhat enhanced wear rates as compared to bars containing coconut fatty acid soaps or nonionic guar gum alone. Likewise, the smear (i.e. the soft, water-soap layer which remains on a toilet bar after the bar has been allowed to stand in a pool of water) of the bars of the present invention is less than that of bars of soap alone, is significantly less than that of soap bars containing nonionic guar gum, and is fully equivalent to (i.e. as low as) that of bars containing an excess of coconut fatty acid.

DETAILED DESCRIPTION OF THE INVENTION

The Soap Component

The soap component of the present compositions is an alkali metal (e.g., sodium or potassium) soap or mixture of soaps of fatty acids containing from about 8 to about 24, preferably from about 10 to about 20 carbon atoms. The fatty acids used in making the soaps can be obtained from natural sources such as, for instance, plant or animal-derived glycerides (e.g., palm oil, coconut oil, babassu oil, soybean oil, castor oil, whale oil, fish oil, tallow, grease, lard and mixtures thereof). The fatty acids can also be synthetically prepared (e.g., by oxidation of petroleum stocks by the Fischer-Tropsch process).

Alkali metal soaps can be made by direct saponification of the fats and oils or by the neutralization of the free fatty acids which are prepared in a separate manufacturing process. Particularly useful are the sodium and potassium salts of the mixtures of fatty acids derived from coconut oil and tallow, i.e., sodium and potassium tallow and coconut soaps.

The term "tallow" is used herein in connection with fatty acid mixtures which typically have an approximate carbon chain length distribution of 2.5% $C_{14}$, 29% $C_{16}$, 23% $C_{18}$, 2% palmitoleic, 41.5% oleic and 3% linoleic. (The first three fatty acids listed are saturated.) Other mixtures with similar distribution, such as the fatty acids derived from various animal tallows and lard, are also included within the term tallow. The tallow can also be hardened (i.e., hydrogenated) to convert part or all of the unsaturated fatty acid moieties to saturated fatty acid moieties.

When the terms "coconut oil" and "coconut fatty acid" (CNFA) are used herein, they refer to fatty acid mixtures which typically have an approximate carbon chain length distribution of about 8% $C_8$, 7% $C_{10}$48% $C_{12}$, 17% $C_{14}$9% $C_{16}$, 2% $C_{18}$, 7% oleic, and 2% linoleic. (The first six fatty acids listed are saturated.) Other sources having similar carbon chain length distribution such as palm kernel oil and babassu kernal oil are included with the terms coconut oil and coconut fatty acid.

In the compositions of the present invention, the soap component is preferably either sodium soap or a mixture of sodium and potassium soap wherein the mixture contains no more than about 25% by weight potassium soap.

Also it is preferable in such bars that the total soap component comprises (a) from about 20% to 80% by weight of the soap component of a mixture containing soaps having from 8 to 14 carbon atoms and (b) from about 20% to 80% by weight of the soap component of soaps having from about 16 to 20 carbon atoms.

Soaps having such preferred chain length distribution characteristics can be realized by utilizing mixtures of tallow and coconut fatty acids in tallow/coconut weight ratios varying between 90:10 and 50:50. A mixture of soaps of tallow and coconut fatty acids in the tallow/coconut weight ratio of 80:20 is especially preferred.

The Nonionic Guar Gum-FA Complex

The essential component of the toilet bar of the present invention is the pre-reacted nonionic guar gum-fatty acid-alkali metal hydroxide complex referred to as the "guar gum-FA complex."

Guar gum is a natural material derived from the ground endosperms of *Cyamopsis tetragonolobus*. Preferably, the guar gum used in the present invention is a free flowing powder having a particle size of about 150 mesh. Suitable guar gum is sold under the Jaguar trademark (e.g. Jaguar A-40-F) by Hi-Tek Polymers. In the discussion that follows, guar gum will be specifically mentioned; an equivalent amount of hydroxypropyl guar gum can also be used as can mixtures of guar gum and hydroxypropyl guar gum.

The fatty acid used in the guar gum-FA complex can be any fatty acid having a carbon chain length of from about 10 to about 20 carbon atoms. Mixtures of fatty acids can be used. Preferably, the fatty acid is coconut fatty acid (CNFA) as described hereinbefore. CNFA generally has a melting point of about 30° to about 35° C. Suitable CNFA is sold by The Procter & Gamble Company of Cincinnati, Ohio. In the discussion that follows, CNFA will be used as an example of a suitable fatty acid; equivalent amounts of other fatty acids can be used.

The alkali metal hydroxides used herein are staple items of commerce. While sodium hydroxide is the preferred base, other bases such as potassium hydroxide and amines used in cosmetic compositions (e.g., triethanolamine) and mixtures of bases can be used. The alkali metal hydroxide is generally incorporated into the complex as a 50% to 70% aqueous solution. The following discussion will use sodium hydroxide as an example of a suitable base; equivalent amounts of other bases can be used.

The guar gum-FA complex comprises one part by weight nonionic guar gum and from about 1 to about 12 parts by weight coconut fatty acid. The amount of sodium hydroxide incorporated into the complex is an amount sufficient to provide the hereinafter described reaction. This amount is generally from about 0.03 to about 0.2 part by weight sodium hydroxide (100% basis) per each part by weight of coconut fatty acid in the complex. Preferably, the complex comprises one part guar gum and from about 1.5 to about 3 parts coconut fatty acid. Most preferably, the complex comprises 1 part guar gum and 2 parts coconut fatty acid. Also most preferably, the complex comprises about 0.06 part sodium hydroxide per part coconut fatty acid.

To prepare the complex, the coconut fatty acid is placed in the molten (liquified) state by heating it to at least its melting point. Modest elevation of the temperature of the CNFA above its melting point is permissible, but is not generally considered necessary. The appropriate quantity of guar gum is then added to the molten CNFA with agitation so as to form a suspension of guar gum in the CNFA. The sodium hydroxide solution is then added to the guar gum-FA suspension with agitation.

Addition of the sodium hydroxide to the suspension results in an elevation of the temperature of the system. Surprisingly, addition of the sodium hydroxide to the suspension is also accompanied by a distinct change in color and physical property of the suspension. The milky white color of the guar gum suspension is transformed into a decided green shade. The viscosity of the system increases markedly. At the end point of addition of the sodium hydroxide, and completion of the formation of the guar gum-coconut fatty acid-sodium hydroxide complex, the system has the color and consistency of pea soup.

Upon completion of the addition of the sodium hydroxide and formation of the complex (i.e. the formation of the "pre-reacted" guar gum-coconut fatty acid-sodium hydroxide complex) and its cooling to ambient temperatures, the guar gum-CNFA complex is ready for use in the toilet bars of the present invention.

The guar gum-FA complex is incorporated into the soap composition of this invention (as described below) in such amounts that the composition comprises from about 0.5% to about 8% guar gum, which guar gum is, of course, contained within the guar gum-FA complex as it is introduced into the composition. Preferably, the composition comprises from about 2% to about 5% guar gum.

Optional Components

The toilet bar compositions of the present invention can contain optional components such as those conventionally found in toilet bars.

The toilet bars generally contain from about 8% to about 20% water.

Conventional antibacterial agents can be included in the present compositions at levels of from about 0.5% to about 4%. Typical antibacterial agents which are suitable for use herein are 3,4-di- and 3,4',5-tribromosalicyla-anildes; 4,4'-dichloro-3-(trifluoromethyl) carbanilide; 3,4,4'-trichlorocarbanilide and mixtures of these materials.

Conventional nonionic emollients can be included as additional skin conditioning agents in the compositions of the present invention at levels up to about 40%, preferably at levels of from about 1% to about 25%. Such materials include, for example, mineral oils, paraffin wax having a melting point of from about 100° F. to about 170° F., fatty sorbitan esters (see U.S. Pat. No. 3,988,255, Seiden, issued Oct. 26, 1976, incorporated by reference herein), lanolin and lanolin derivatives, esters such as isopropyl myristate and triglycerides such as coconut oil or hydrogenated tallow.

Free fatty acid such as coconut fatty acid can be added to the compositions herein to improve the volume and quality (creaminess) of the lather produced by the compositions herein.

Conventional perfumes, dyes and pigments can also be incorporated into compositions of the invention at levels up to about 5%. Perfumes are preferably used at levels of from about 0.5% to 3% and dyes and pigments are preferably used at levels of from about 0.001% to about 0.5%.

Synthetic detergents can also be present in compositions herein. Preferred types of synthetic detergents are of the anionic or nonionic type. Examples of anionic synthetic detergents are the salts of organic sulfuric reaction products such as alkyl sulfates having the formula $$R_{24}OSO_3M;$$

alkyl sulfonates having the formula $$R_{24}SO_3M;$$

alkyl ether sulfates having the formula $$R_{24}(OC_2H_4)_x\,OSO_3M;$$

alkyl monoglyceride sulfonates having the formula

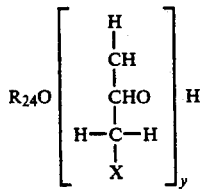

and alkyl benzene sulfonates having the formula

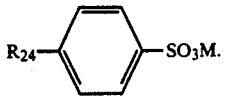

In the above formulae, $R_{24}$ is a straight or branched chain alkyl of from 8 to about 24 carbon atoms; M is an alkali metal or ammonium ion; x is a number of from 1 to about 10; y is a number of from 1 to 4; and X is selected from the group consisting of chlorine, hydroxyl, and—$SO_3M$, at least one X in each molecule being—$SO_3M$. Examples of nonionic synthetic detergents are ethoxylated fatty alcohols (e.g., the reaction product of one mole of coconut fatty alcohol with from about 3 to 30 moles of ethylene oxide) and fatty acid amides such as coconut fatty acid monoethanolamide and stearic acid diethanolamide. Although it may be desirable in some instances to incorporate synthetic detergents into the compositions of the present invention, the compositions herein can be free of synthetic detergents. Synthetic detergents when present are normally employed at levels of from about 1% to about 300% by weight of the amount of soap in the compositions.

Insoluble alkaline earth metal soaps such as calcium stearate and magnesium stearate can also be incorporated into compositions of the present invention at levels up to about 30%. These materials are particularly useful in toilet bars in which synthetic detergents are present in that they tend to reduce the relatively high solubility which such bars normally have. These alkaline earth metal soaps are not included within the term "soap" as otherwise used in this specification. The term "soap" as used herein refers to the alkali metal soaps.

Bar Preparation

Toilet bars of the present invention can be prepared in the conventional manner. Guar gum-FA complex is added to noodles of the base soap mixture containing from about 10% to about 22% moisture in an amalgamator. Any optional ingredients such as perfumes, dyes, etc. are also added to the amalgamator. The mixture is processed in the amalgamator and milled in the conventional manner under conventional conditions. It is then extruded (plodded) into logs for cutting and stamping into toilet bars.

The following examples are presented by way of illustration only and not be way of limitation.

EXAMPLE I

78 Grams (g) Guar Gum (Jaguar A-40-F) is dispersed in 156 g CNFA; 20 g of 50% aqueous NaOH is added to the suspension and allowed to react until the green guar gum-FA complex is formed. This complex and the following materials are then added to a conventional amalgamator.

| | |
|---|---|
| Soap (Sodium; 80% tallow, 20% Coconut; 15.2% moisture) | 3,400 g |
| Water | 210 |
| Perfume | 43 |
| $Na_4EDTA$ (40% active) | 5 |
| $TiO_2$ | 8 |
| 1% FD&C Red #4 | 10 |
| Citric Acid (50% Active) | 20 |

The mixture is milled a total of four times, plodded, and stamped into toilet bars of convenient size and shape. The resulting bars demonstrate the enhanced physical properties, lather properties, and mildness mentioned above.

EXAMPLE II

Toilet bars are prepared as in Example I, except the following materials and quantities are used:

| | |
|---|---|
| Guar Gum | 268 g |
| CNFA | 535 |
| NaOH (70% aqueous) | 50 |
| Soap (Sodium, 80% tallow, 20% Coconut; 17.5% moisture) | 6050 |
| Perfume | 74 |
| $NA_4EDTA$ (40% active) | 10 |
| $TiO_2$ | 13 |
| 1% FD&C Red #4 | 17 |
| Citric Acid (50% active) | 34. |

The resulting bars exhibit the enhanced physical and lather properties mentioned above and are exceptionally mild.

EXAMPLE III

Example I is repeated, except hydroxypropyl guar gum (as sold under the trademark Jaguar HP-8) is substituted for the guar gum. Equivalent results are obtained.

EXAMPLE IV

Example I is repeated, except tallow fatty acid, as hereinbefore described, is substituted for CNFA. Equivalent results are obtained.

In addition to the toilet bars discussed above, the guar gum-FA complex improves the mildness and performance characteristics of other personal cleansing products containing surface active agents. These personal cleaning products include toilet bars based on synthetic detergents; fluid detergent compositions such as liquid soaps, hand cleaners, facial cleansers, bath and shower foams, shampoos; and the like. The complex is also useful in laundry bars containing surface active agents and detergency builders. In fluid detergent compositions, the nonionic guar gum is preferably present at from about 0.1% to about 1.5%.

EXAMPLE V

A liquid personal cleaning product is prepared as follows: A first mixture is prepared by mixing at 71° C. the following materials:

| Material | Weight, g |
|---|---|
| Water | 46 |
| Sodium coconut ether sulfate (3 ethylene oxide groups); 28% | 177 |
| Propylene glycol | 30 |
| Glycerine | 20 |
| $Na_4EDTA$ | 1 |
| Preservatives | 3 |
| Coconut monoethanol amide | 45 |
| Opacifier and Color | 11 |

A nonionic guar gum-FA complex is prepared by reacting as described:

| Material | Weight, g |
|---|---|
| Guar Gum (natural) | 300 |
| Coconut fatty acid | 600 |
| Sodium hydroxide | 80 |

A second mixture is prepared by mixing at room temperature:

| Material | Weight, g |
|---|---|
| Water | 91 |
| Sodium coconut ether sulfate (3 ethylene oxide groups); 28% | 354 |
| Sodium laureth 3 sulfosuccinate; 30% | 125 |
| Propylene glycol | 59 |
| Nonionic guar gum-FA Complex | 10 |

The first mixture and the second mixture are combined. Three grams of perfume is added. The product exhibits enhanced mildness and improved stability as compared to a similar product without the nonionic guar gum-FA complex.

What is claimed is:

1. A toilet bar comprising from about 65% to about 90% by weight alkali metal soap (anhydrous basis) and from about 0.5% to about 8% by weight nonionic guar gum, said nonionic guar gum being provided in a prereacted nonionic guar gum complex wherein said complex is prepared by suspending 1 part by weight guar gum in from about 1 to about 12 parts by weight molten fatty acid and reacting therewith from about 0.03 to about 0.2 part by weight alkali metal hydroxide per each part by weight said fatty acid.

2. The toilet bar of claim 1 comprising from about 2 to about 5% nonionic guar gum, wherein said complex is prepared by suspending one part by weight nonionic guar gum in from about 1.5 to about 3 parts by weight fatty acid.

3. The toilet bar of claim 1 wherein said alkali metal soap comprises a mixture of alkali metal tallow soap and alkali metal coconut soap.

4. The toilet bar of claim 3 wherein said nonionic guar gum is present at from about 2 to about 5% by weight and wherein said complex is prepared by suspending one part by weight nonionic guar gum in from about 1.5 to about 3 parts by weight fatty acid.

5. The toilet bar of claim 3 wherein said mixture of alkali metal tallow soap and alkali metal coconut soap comprises from about 1 to about 9 parts by weight alkali metal tallow soap per part by weight alkali metal coconut soap.

6. The toilet bar of claim 5 wherein said nonionic guar gum is present at from about 2 to about 5% by weight and wherein said complex is prepared by suspending 1 part by nonionic weight guar gum in from about 1.5 to about 3 parts by weight fatty acid.

7. The toilet bar of claim 6 wherein said nonionic guar gum and said fatty acid are reacted with about 0.06 part by weight alkali metal hydroxide per each part by weight said fatty acid.

8. A toilet bar comprising from about 65% to about 90% by weight alkali metal soap, said alkali metal soap comprising a mixture of alkali metal tallow soap and alkali metal coconut soap, wherein said mixture of alkali metal soaps comprises about 4 parts by weight tallow soap per part by weight coconut soap; and about 4% by weight nonionic guar gum, said guar gum being provided in a pre-reacted guar gum complex wherein said complex is prepared by suspending one part by weight nonionic guar gum in about 2 parts by weight molten fatty acid and reacting therewith about 0.06 part by weight alkali metal hydroxide per each part by weight said fatty acid.

9. A process for preparing toilet bars comprising the steps of:

(a) forming a pre-reacted nonionic guar gum complex by suspending one part by weight nonionic guar gum in from about 1 to about 12 parts by weight molten fatty acid and reacting therewith from about 0.03 to about 0.2 part by weight alkali metal hydroxide per each part by weight said fatty acid;

(b) forming a mixture of said pre-reacted nonionic guar gum complex and alkali metal soap wherein said nonionic guar gum is present in said mixture at from about 0.5% to about 8% by weight of said mixture;

(c) milling said mixture;

(d) plodding said milled mixture;

(e) extruding said milled and plodded mixture; and (f) stamping said extruded mixture into said toilet bars.

10. A cleaning composition comprising surface active agent and at least about 0.1% nonionic guar gum, said nonionic guar gum being provided in a pre-reacted nonionic guar gum complex wherein said complex is prepared by suspending 1 part by weight guar gum in from about 1 to about 12 parts by weight molten fatty acid and reacting therewith from about 0.03 to about 0.2 part by weight alkali metal hydroxide per each part by weight said fatty acid.

* * * * *